US009573285B2

(12) United States Patent
Barsotti Giovanni

(10) Patent No.: US 9,573,285 B2
(45) Date of Patent: Feb. 21, 2017

(54) LOG SAW MACHINE

(71) Applicant: UNIVERSAL TISSUE TECHNOLOGY SRL, Lucca (IT)

(72) Inventor: Bertoli Barsotti Giovanni, Lucca (IT)

(73) Assignee: Universal Tissue Technology SRL, Lucca (IT)

( * ) Notice: Subject to any disclaimer, the term of this patent is extended or adjusted under 35 U.S.C. 154(b) by 219 days.

(21) Appl. No.: 14/151,934

(22) Filed: Jan. 10, 2014

(65) Prior Publication Data

US 2015/0068380 A1 Mar. 12, 2015

(30) Foreign Application Priority Data

Sep. 9, 2013 (CN) ..... 2013 1 04059071

(51) Int. Cl.
*B26D 3/16* (2006.01)
*B26D 1/143* (2006.01)
*B26D 5/08* (2006.01)

(52) U.S. Cl.
CPC ..... *B26D 3/16* (2013.01); *B26D 1/143* (2013.01); *B26D 5/08* (2013.01); *B26D 5/086* (2013.01); *Y10T 83/7793* (2015.04); *Y10T 83/9403* (2015.04)

(58) Field of Classification Search
CPC ..... B26D 3/16; B26D 5/08; B26D 5/086; B26D 1/143; B26D 3/001
USPC ..... 30/370–377, 388–391; 83/491–507
See application file for complete search history.

(56) References Cited

U.S. PATENT DOCUMENTS 2,150,288 A * 3/1939 Moller ..... F41B 11/647 124/67
3,772,761 A 11/1973 Siltari
3,805,661 A 4/1974 Tuomaala
3,905,260 A 9/1975 Nystrand
3,908,499 A * 9/1975 Reed ..... B23D 35/004 83/481
3,951,346 A * 4/1976 Brewer ..... B02C 18/184 241/32
4,416,312 A * 11/1983 Ostberg ..... B23D 53/005 144/376
4,579,025 A * 4/1986 Fasolak ..... B23D 45/124 82/101
4,614,138 A * 9/1986 Altman ..... B26D 1/24 125/23.02
4,657,428 A * 4/1987 Wiley ..... B24B 45/006 30/388

(Continued)

FOREIGN PATENT DOCUMENTS

DE 3423674 C1 11/1985
EP 0391865 B1 8/1995

(Continued)

*Primary Examiner* — Jason Daniel Prone
*Assistant Examiner* — Richard Crosby, Jr.
(74) *Attorney, Agent, or Firm* — Jeffrey D. Lindsay

(57) ABSTRACT

A log saw machine includes a first arm, a second arm parallel to the first arm, a shaft having a first end and an opposite second end, and a circular knife fixed on the shaft. The first end of the shaft is rotatably installed on the first arm. The second end of the shaft is rotatably installed on the second arm. The circular knife is positioned between the first and second arms, and the plane of the circular knife is parallel to the extending direction of the first and second arms.

20 Claims, 5 Drawing Sheets

(56) References Cited

U.S. PATENT DOCUMENTS

| | | | | |
|---|---|---|---|---|
| 5,038,647 | A * | 8/1991 | Biagiotti | B26D 1/54 83/155.1 |
| 5,213,020 | A * | 5/1993 | Pleau | B23D 47/005 83/828 |
| 5,303,688 | A * | 4/1994 | Chiuminatta | B23D 61/025 125/15 |
| 5,315,907 | A * | 5/1994 | Biagiotti | B26D 3/16 83/298 |
| 5,357,833 | A * | 10/1994 | Biagiotti | B26D 7/02 269/130 |
| 5,522,292 | A | 6/1996 | Biagiotti | |
| 5,557,997 | A * | 9/1996 | Wunderlich | B24B 3/368 83/174 |
| 6,123,002 | A | 9/2000 | Wunderlich et al. | |
| 6,532,851 | B2 | 3/2003 | Moss et al. | |
| 6,612,216 | B2 * | 9/2003 | McGehee | B27B 5/36 83/425.4 |
| 6,644,154 | B2 | 11/2003 | Wierschke et al. | |
| 7,100,486 | B2 * | 9/2006 | Akins | B26D 3/20 83/404.1 |
| 7,810,419 | B2 | 10/2010 | Rundell et al. | |
| 7,866,238 | B2 | 1/2011 | Hsu | |
| 8,037,794 | B2 | 10/2011 | Ridolfi et al. | |
| 8,261,646 | B2 * | 9/2012 | De Matteis | B23D 47/04 225/2 |
| 8,910,553 | B2 | 12/2014 | Catelli | |
| 2002/0005102 | A1 | 1/2002 | Takemura et al. | |
| 2003/0110912 | A1 * | 6/2003 | English | B26D 1/22 83/420 |
| 2005/0132860 | A1 * | 6/2005 | Mains | B23D 47/10 83/663 |
| 2011/0083538 | A1 * | 4/2011 | Dietz | B23D 55/082 83/169 |
| 2011/0179931 | A1 * | 7/2011 | Menze | B27B 5/32 83/666 |
| 2012/0064214 | A1 * | 3/2012 | Moore | B26D 3/26 426/518 |

FOREIGN PATENT DOCUMENTS

| | | | |
|---|---|---|---|
| EP | 0982104 | A2 | 3/2000 |
| EP | 2602074 | A1 | 6/2013 |
| JP | 48-79381 | A | 10/1973 |
| JP | 2002-28886 | A | 1/2002 |
| JP | 2003-117884 | A | 4/2003 |
| JP | 2007-144596 | A | 6/2007 |
| JP | 2012-32869 | A | 2/2012 |

* cited by examiner

LOG SAW MACHINE

BACKGROUND

1. Technical Field

The present disclosure generally relates to a log saw machine for cutting web material wound on tubular winding cores (which is called a "log"), and particularly to a log saw machine for cutting JRT (Jumbo Roll Tissue). The cutting is performed by a rotating circular knife.

2. Description of the Related Art

In typical applications, a log such as a wound tissue log is cut into rolls of smaller size by a rotating knife of a log saw machine. The knife rotates around a shaft, and moves toward the log normal to the axis of the log to cut the log.

In conventional systems, the rotational movement of the knife is generally driven by one belt and the knife is mounted on the shaft in a cantilever position. This cantilever position, especially when cutting high density logs, causes a deflection of the shaft which can affect the angle of the knife as it cuts. In other words, the forces on the knife can cause the rotating knife to deflect so it is not perfectly aligned at a right angle to the axis of the log but has some angle of deviation from the right-angle orientation relative to the axis of the log that is needed for best operation.

Therefore, what is needed is a log saw machine which can mitigate the described limitations.

DETAILED DESCRIPTION OF EMBODIMENTS

Figure 1:
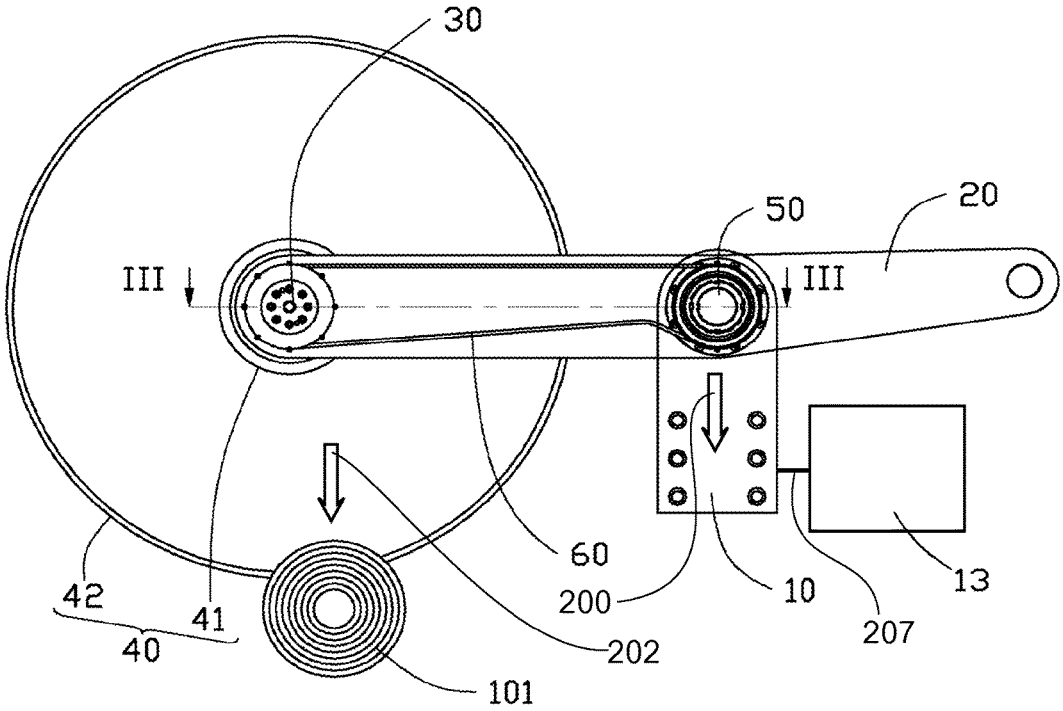
FIG. 1 is a front-side view of a part of a log saw machine, according to an exemplary embodiment of the present disclosure.
Figure 2:
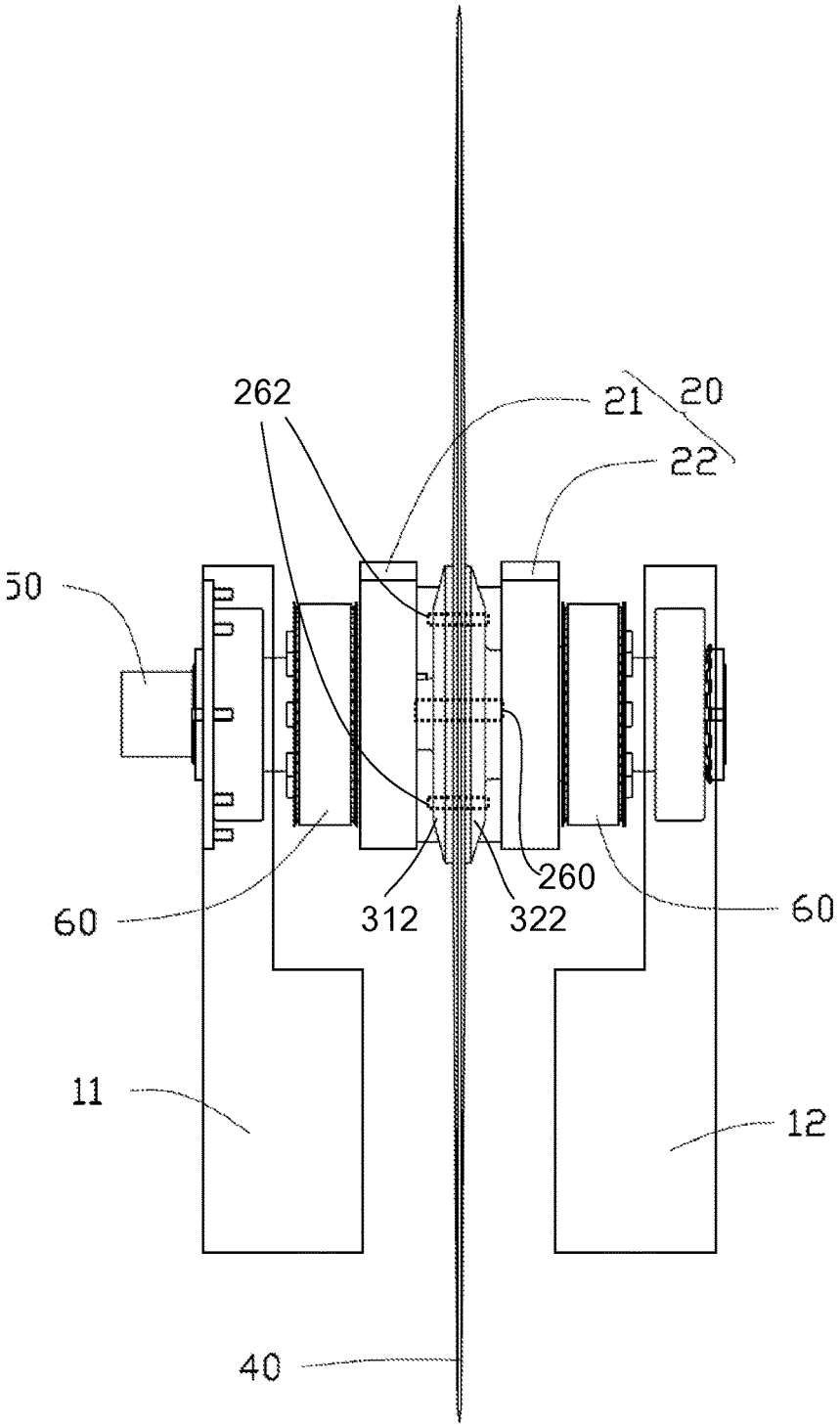
FIG. 2 is a left-side view of the log saw machine of FIG. 1.
Figure 3:
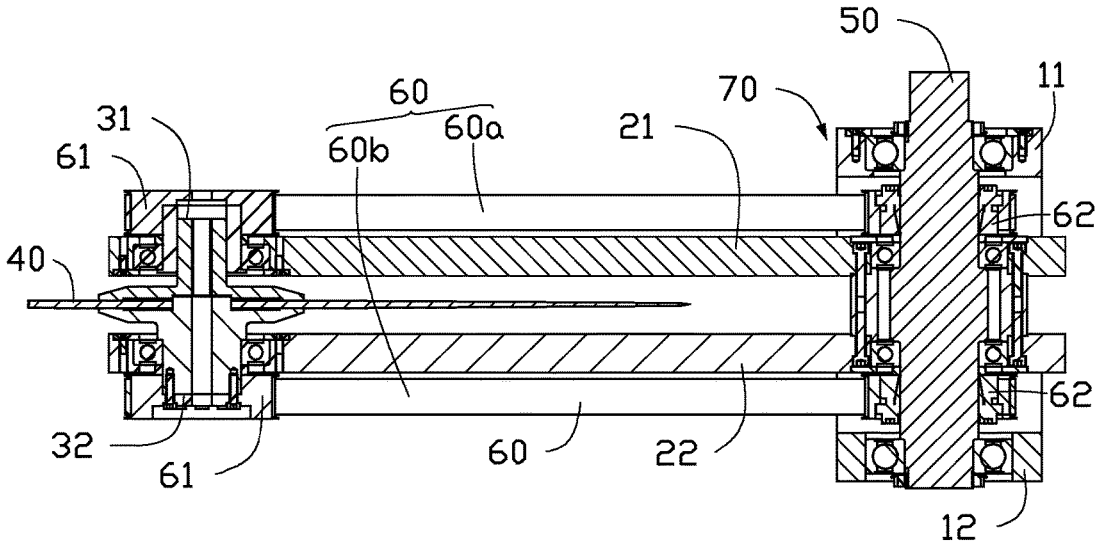
FIG. 3 is a cross-sectional view of FIG. 1, taken along line III-III thereof.

Referring to FIG. 1, FIG. 2 and FIG. 3, a log saw machine in accordance with an exemplary embodiment of the present disclosure comprises a support 10, a fixing arm 20 connecting the support 10, a shaft 30 rotatably installed on the fixing arm 20, and a circular knife 40 secured on the shaft 30. The circular knife 40 and the shaft 30 are capable of rotating rapidly to perform a cutting of a log 101 such as a wound tissue, paper, film, etc.

Acting as a carrier, the support 10 sustains related structures such as the fixing arm 20 and the circular knife 40. The support 10 may be engaged with a transport mechanism 13 for moving the support 10 to change the position of the fixing arm 20 and the circular knife 40 with respect to the log 101, to thereby facilitate the cutting of the log 101. The transport mechanism 13 here is drawn generically as a box connected to the support 10, as indicated by connection 207 drawn generically as a line. The motion of support 10 as driven by the transport mechanism 13 and shown by arrow 200, induces motion of the circular knife 40 toward the log 101, as indicated by arrow 202.

The fixing arm 20 comprises a first arm 21 and a second arm 22 parallel to the first arm 21. Each of the first and second arms 21, 22 has an elongated shape. The extending direction of the first and second arms 21, 22 is perpendicular to the axial direction of the log. In other words, the extending direction of the first and second arms 21, 22 is parallel to the plane of the circular knife 40.

The shaft 30 comprises a first end section 31 and a second end section 32 opposite to the first end section 31. The axis of the shaft 30 is substantially perpendicular to the extending direction of the first and second arms 21, 22 and typically parallel to the axis of the log 101 as it is being cut. The first end section 31 is rotatably mounted on a free end of the first arm 21, and the second end section 32 is rotatably mounted on a free end of the second arm 22. Bearings (not shown) such as sliding bearings or ball bearings are familiar elements used to sustain such a connection between the shaft 30 and the fixing arm 20.

The circular knife 40 is positioned between the first arm 21 and the second arm 22. The circular knife 40 comprises a securing portion 41 at a center thereof and an edge portion 42 extending radially from a periphery of the securing portion 41. The securing portion 41 is engaged with the shaft 30 to secure the circular knife 40 onto the shaft 30. The rotating of the circular knife 40 is synchronous with the rotating of the shaft 30. When the circular knife 40 moves toward the log 101, the edge portion 42 of the rotating circular knife 40 penetrates into the log 101 to perform the cutting operation.

During the operation of the log saw machine provided by the present disclosure, with the first and second end sections 31, 32 of the shaft 30 are both supported by the fixing arm 20, the deflection of the shaft 30 and the circular knife 40 during the cut can be substantially reduced, even when cutting high density logs. Thus, the circular knife 40 can remain orthogonal to the shaft 30 and the axis of the log, and the cut surface of the log is aligned at a right angle to the axis of the log. Likewise, the deflection of first and second arms 21, 22 can also be substantially reduced.

The rotation of the shaft 30 is driven by a driving module 70. In the present embodiment, the driving module 70 comprises a driving spindle 50 and a transmission component 60. The driving spindle 50 is mounted on the support 10. The driving spindle 50 is parallel to the shaft 30. The driving spindle 50 can be an output shaft of a power supply such as an electric motor (not shown). Alternatively, the driving spindle 50 can be connected to the output shaft of the power supply, and used to transfer a rotational drive from the power supply to the shaft 30. The driving spindle 50 is connected to the shaft 30 by the transmission component 60. The transmission component 60 transfers the rotational drive from the driving spindle 50 to the shaft 30.

The transmission component 60 can be transmission belt, transmission chain, rope, etc. In the present embodiment, the transmission component 60 is transmission belt, and pulleys 61, 62 are arranged on the shaft 30 and the driving spindle 50 for accommodating the transmission belt. It is understood that other types of components such as sprockets (not shown) can be installed on the shaft 30 and the driving spindle 50 according to different types of the transmission component 60.

In one embodiment, both the first and second end sections 31, 32 of the shaft 30 are respectively equipped with a transmission component 60*a*, 60*b*, to avoid the torsional deflection of the shaft 30 during the rotating operation. In this manner, torque being applied simultaneously on both sides of the shaft 30 about the circular knife 40 reduces the tendency for the applied torque to cause deflection of the circular knife 40. Specifically, the first end 31 of the shaft 30 extends to penetrate into the first arm 21 or otherwise connect securely with the first arm 21, and a corresponding transmission component 60*a* is associated with the first arm 21 and adapted to transmit torque to the first end section 31 of the shaft 30. The second end section 32 of the shaft 30 oppositely extends to penetrate into the second arm 22 or otherwise connect securely with the second arm 22, and another corresponding transmission component 60*b* is associated with the second arm 22 and adapted to transmit torque to the second end section 31 of the shaft 30. In this embodiment, the two transmission components 60*a*, 60*b* as shown are symmetrical with the surface of the circular knife 40, though they need not be strictly symmetrical.

In an alternative embodiment (not shown), more than one driving spindle 50 may be provided, and the two transmission components 60*a*, 60*b* can be independently connected with the respective driving spindles 50. The driving spindles 50 can be disposed at different positions of the support 10. Thus, there is an opportunity to independently control the two transmission components 60*a*, 60*b*.

The support 10 in the depicted embodiment comprises a first bracket 11 and a second bracket 12 standing substantially parallel to each other. The driving spindle 50 is rotatably installed on the first and second brackets 11, 12.

Specifically, the driving spindle 50 is rotatably installed on the first and second arms 21, 22 of the fixing arm 20. In other words, as depicted, the driving spindle 50 is rotatably installed on the fixing arm 20 and the support 10, though other orientations and configurations are possible within the scope of the present invention. The first and second arms 21, 22 of the fixing arm 20 extend between the first and second brackets 11, 12 of the support 10, and the free ends of the first and second arms 21, 22 are apart from the first and second brackets 11, 12.

Further, in some embodiments the shaft 30 may be designed to be separable into two parts to allow an easy replacement of the circular knife 40 when worn. As shown in more detail in FIG. 5, the first and second end sections 31, 32 are detachably engaged with each other, and the circular knife 40 is fixed between the first and second end sections 31, 32 of the shaft 30. Upon detachment of the first and second end sections 31, 32 relative to each other, an operator can relatively easily perform the replacement of the circular knife 40 fixed therebetween, which can eliminate the need for time-consuming disassembly of the fixing arm 20 and the support 10.

Figure 4:
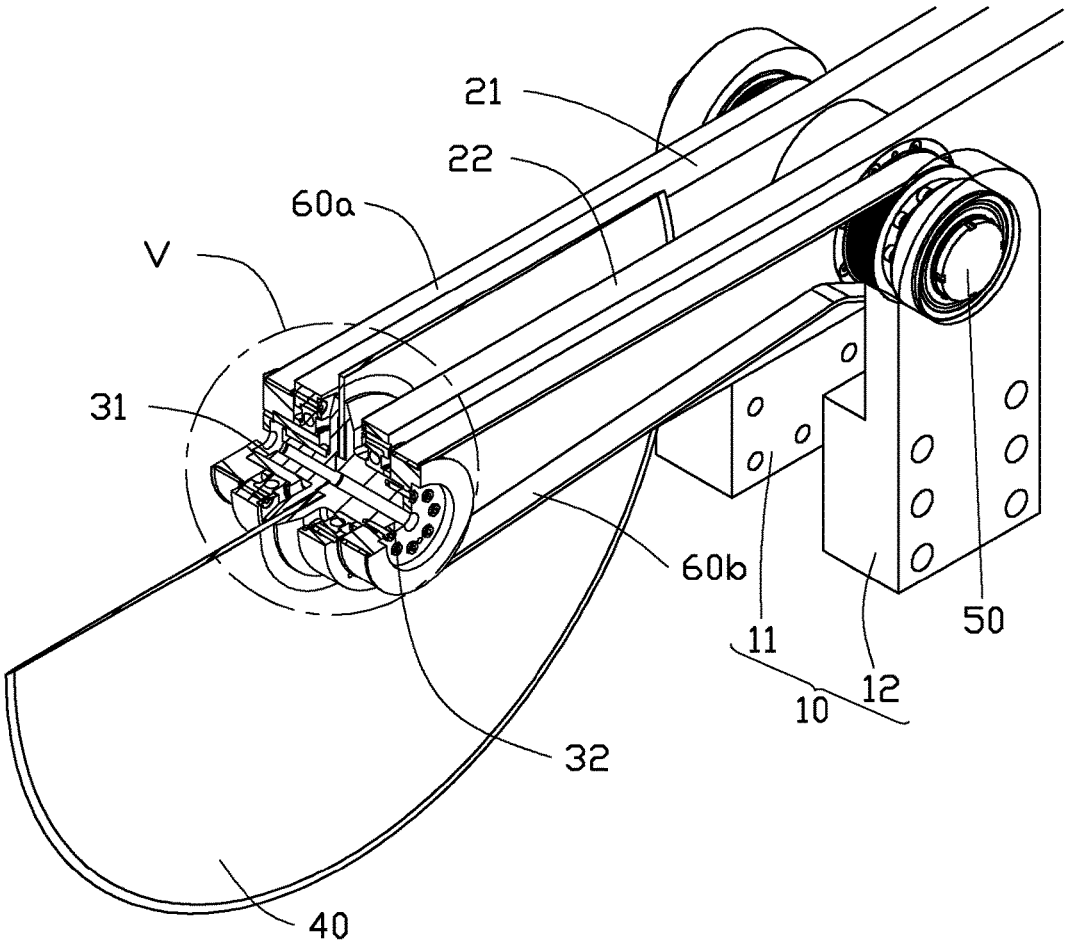
FIG. 4 is an isometric view of the log saw machine of FIG. 1, wherein removed portion has been removed to clearly show an inner structure thereof.
Figure 5:
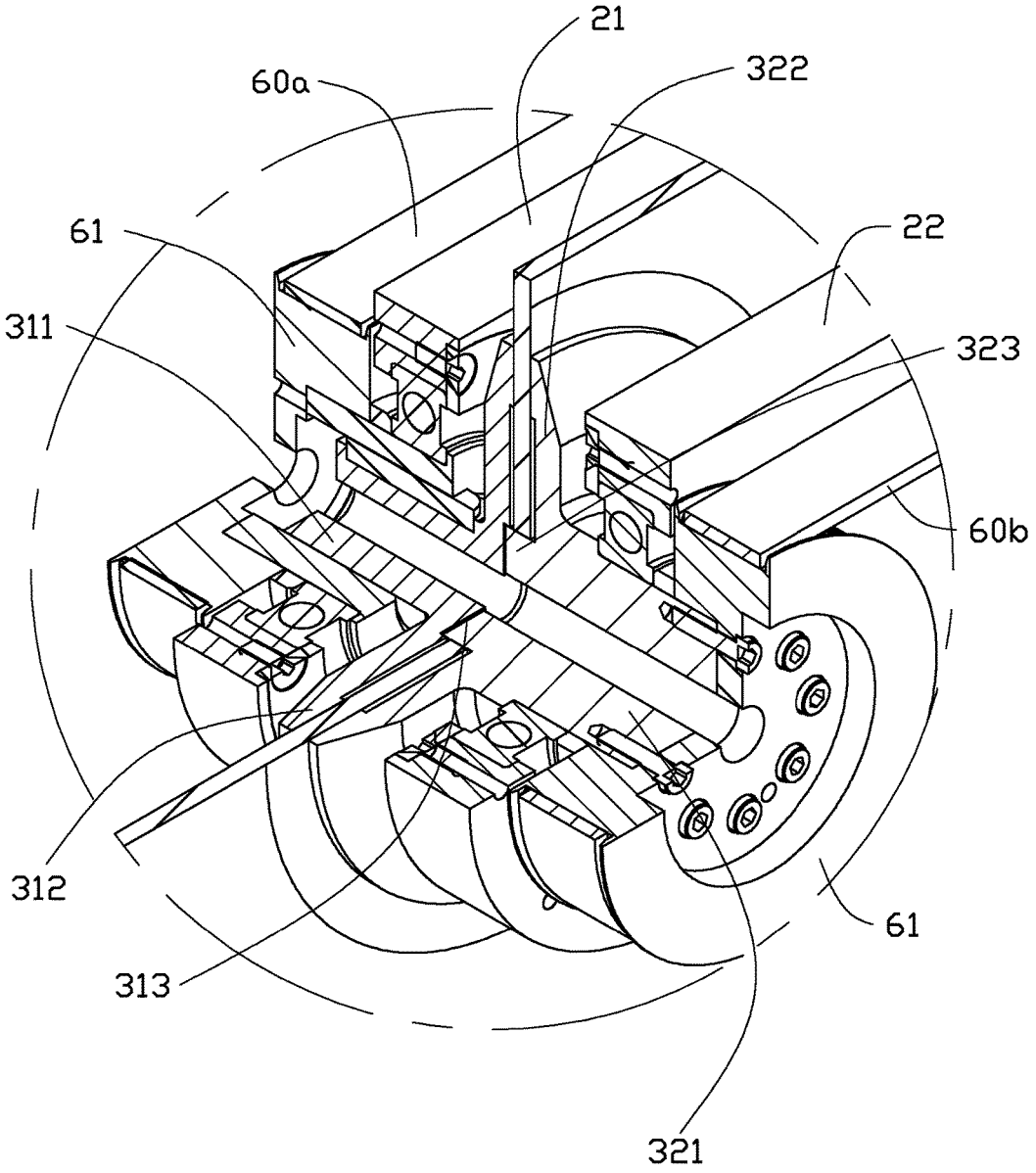
FIG. 5 is an enlarged view of a circled portion V of FIG. 4.

FIG. 4 and FIG. 5 show the detailed structures of the shaft 30 in accordance with an exemplary embodiment. The first end section 31 of the shaft 30 comprises a first mounting section 311 and a first holding section 312 extending from the first mounting section 311. The first mounting section 311 inserts into the first arm 21, and is rotatably installed in the first arm 21 via bearings. The first holding section 312 has a disk shape. The first holding section 312 is positioned between the first and second arms 21, 22 for holding and securing the circular knife 40. A recess 313 is defined in the first holding section 312. The recess 313 faces the second arm 22.

The second end section 32 of the shaft 30 comprises a second mounting section 321 and a second holding section 322 extending from the second mounting section 321. The second mounting section 321 inserts into the second arm 22, and is rotatably installed in the second arm 22 via bearings. The second holding section 322 has a disk shape. The second holding section 322 is positioned between the first and second arms 21, 22 and cooperates with the first holding section 312 for holding and securing the circular knife 40. A protrusion 323 extends outwardly from the second holding section 322 and faces the recess 313 of the first holding section 312. When the circular knife 40 is assembled, the protrusion 323 is received in the recess 313, and the circular knife 40 is mounted on the protrusion 323 and intimately sandwiched between the first and second holding sections 312, 322.

The engagement of the first and second end sections 31, 32 of the shaft 30 can be accomplished by inserting a connector such as screw (not shown) through a penetrating hole defined in the first and second end sections 31, 32, extending along the axial direction of the shaft 30. (See first connector 260 in FIG. 2, drawn generically as a box without specifying the specific form or dimensions of the connector.) Alternatively, or at the same time, a plurality of securing holes can be defined in the first and second holding sections 312, 322 for connectors extending therethrough to combine the first and second holding sections 312, 322 together, as shown in FIG. 2, showing second connectors 262 passing through the circular knife 40 and the first and second holding sections 312, 322. The second connectors 262 are drawn generically as boxes without specifying the specific form or length thereof. Of course, the circular knife 40 may also be provided with corresponding securing holes thereon for the connectors extending therethrough.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A log saw machine for cutting a log of wound material normal to its axis comprising:

a first arm;

a second arm parallel to the first arm;

a shaft comprising a first end section and an opposing second end section, the first end section rotatably installed on the first arm, and the second end section rotatably installed on the second arm, wherein the first end section and the second end section are detachably engaged with each other;

at least one driving spindle associated with the shaft, wherein at least one transmission component associates the first end section of the shaft with at least one driving spindle, and at least one transmission component likewise associates the opposing second end section of the shaft with at least one driving spindle, whereby torque is applied from the at least one driving spindle to both the first and the opposing second end sections of the shaft;

and a circular knife fixed on the shaft, the circular knife being positioned between the first and second arms, and the circular knife defining a plane parallel to the first and second arms, wherein the circular knife is secured and sandwiched between the first end section and second end section of the shaft, wherein the torque that is applied from the at least one driving spindle to both the first and the opposing second end sections of the shaft drives rotation of the circular knife, and wherein the log saw further comprises a support attached to the first and second arms, the support being engaged with a transport mechanism which is adapted to change the position of the support and thereby move the first and second arms to induce motion of the circular knife toward the log to facilitate cutting of the log.

2. The log saw machine of claim 1 wherein the at least one driving spindle is rotatably installed on the support, and two transmission components are disposed on the at least one driving spindle and the shaft to transfer a rotational drive from the at least one driving spindle to both the first end and the second end of the shaft.

3. The log saw machine of claim 2, wherein the transmission components are symmetrical with respect to the plane of the circular knife.

4. The log saw machine of claim 2, wherein the at least one driving spindle is rotatably installed on the first arm and the second arm.

5. The log saw machine of claim 4, wherein the support comprises a first bracket and a second bracket standing parallel to each other, the at least one driving spindle is installed on the first and second bracket, and the first and second arms extend between the first and second brackets.

6. The log saw machine of claim 1, wherein the first end-section comprises a first mounting section and a first holding section extending from the first mounting section, the first mounting section being engaged with the first arm, and a recess being defined in the first holding section, and wherein the second end-section comprises a second mounting section and a second holding section extending from the second mounting section, the second mounting section being engaged with the second arm, a protrusion extending from the second holding section and being received in the recess, and the circular knife being mounted on the protrusion and sandwiched between the first and second holding sections.

7. A log saw machine comprising:

a support;

a first arm and a second arm mechanically connected to the support and each having a free end apart from the support;

at least one driving spindle rotatably installed on the support;

a shaft comprising a first end section and an opposing second end section, the first end section rotatably installed on the free end of the first arm, and the second end section rotatably installed on the free end of the second arm, the first and second end sections being connected to each other;

a circular knife fixed on the shaft, the circular knife being positioned between the first and second arms and defining a plane, and the plane of the circular knife being parallel to the first and second arms; and a first transmission component and a second transmission component, cooperatively associated with the shaft and the driving spindle for transferring a rotational drive from the driving spindle to the shaft, the first and second transmission components being respectively installed such that the first transmission component is drivingly connected to the first end section of the shaft and the second transmission component is drivingly connected to the second end section-of the shaft, whereby torque is applied simultaneously to both sides of the circular knife, and wherein a transport mechanism is attached to the support and is adapted to move the support which in turn changes the position of the first and second arms and thereby the circular knife to cause the circular knife to move toward a log of wound material to facilitate the cutting of the log normal to the axis of the log.

8. The log saw machine of claim 7, wherein the driving spindle is rotatably installed on the first and second arms.

9. The log saw machine of claim 7, wherein the transmission components are symmetrical with respect to the plane of the circular knife.

10. The log saw machine of claim 7, wherein the transmission components are selected from a belt, rope, and chain.

11. The log saw machine of claim 7, wherein the first end section and the second end section are detachably engaged with each other, and wherein the circular knife is secured and sandwiched between the first end section and second end section of the shaft.

12. The log saw machine of claim 11, wherein the first end-section comprises a first mounting section and a first holding section extending from the first mounting section, the first mounting section inserting in the first arm, and a recess being defined in the first holding section, and wherein the second end-section comprises a second mounting section and a second holding section extending from the second mounting section, the second mounting section inserting in the second arm, a protrusion extending from the second holding section and being received in the recess, and the circular knife being mounted on the protrusion and sandwiched between the first and second holding sections.

13. The log saw machine of claim 7, wherein the first end section of the shaft extends to penetrate through the first arm, and the corresponding first transmission component is mounted on the part of first end section which extends beyond the first arm, and wherein the second end section of the shaft oppositely extends to penetrate through the second arm, and the corresponding second transmission component is mounted on the part of the second end section which extends beyond the second arm.

14. A log saw machine for cutting a log of wound material normal to its axis, comprising:

a first arm and a second arm arranged side-by-side and cantileverly extending from a support to respective free ends of the first arm and the second arm;

a shaft comprising a first end section and a second end section, the shaft extending between the first arm and the second arm, the first end section rotatably installed at the free end of the first arm, and the second end section rotatably installed at the free end of the second arm; and a single circular knife fixed on the shaft, the circular knife being positioned between the first and second arms, and the circular knife defining a plane intermediate to the first and second arms, the shaft being parallel an axis of a log as it is being cut;

a driving spindle on the support;

two transmission components extending from the driving spindle to the shaft, to transfer rotational drive from the driving spindle to the shaft, whereby torque is applied simultaneously to both sides of the circular knife, and a transport mechanism attached to the support, wherein the transport mechanism is adapted to move the support and thereby to change the position of the first and second arms and the circular knife, such that the circular knife moves toward a log of wound material in response to motion of the support to facilitate the cutting of the log.

15. The log saw machine of claim 14 wherein the at least one transmission component comprises two transmission components extending from the driving spindle to the shaft, such that rotational drive from the first and second transmission components is applied to opposing sides of the circular knife.

16. The log saw machine of claim 14, wherein the circular knife is secured between the first end section and the second end section of the shaft.

17. The log saw machine of claim 16, wherein the circular knife is adapted to move toward the log to cut the log normal to the axis of the log.

18. The log saw machine of claim 14, wherein the first end section of the shaft comprises a holding section, and wherein the second end section of the shaft comprises a second holding section, wherein the first holding section and the second holding section cooperate to secure the circular knife, and wherein the first end section and the second end section are joined by at least one of a connector passing through the center of the shaft and one or more connectors passing through the first and second holding sections and through the circular knife.

19. The log saw machine of claim 1, wherein the at least one driving spindle is a single driving spindle.

20. The log saw machine of claim 7, wherein the at least one driving spindle is a single driving spindle.

* * * * *